US006914569B2

(12) United States Patent
Na

(10) Patent No.: US 6,914,569 B2
(45) Date of Patent: Jul. 5, 2005

(54) BUILT-IN ANTENNA TERMINAL PART SUPPORTING DEVICE

(75) Inventor: Gi Lyong Na, Suwon (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 74 days.

(21) Appl. No.: 10/686,673

(22) Filed: Oct. 17, 2003

(65) Prior Publication Data

US 2004/0263395 A1 Dec. 30, 2004

(30) Foreign Application Priority Data

Jun. 24, 2003 (KR) ..... 10-2003-0041286

(51) Int. Cl.[7] ..... H01Q 1/24
(52) U.S. Cl. ..... 343/702
(58) Field of Search ..... 343/702, 700 MS, 343/829, 830, 846, 795

(56) References Cited

U.S. PATENT DOCUMENTS 5,146,232 A * 9/1992 Nishikawa et al. ..... 343/713
6,262,684 B1 * 7/2001 Stewart et al. ..... 343/702
6,292,154 B1 * 9/2001 Deguchi et al. ..... 343/806
6,414,641 B1 7/2002 Carlson et al. ..... 343/702
6,448,931 B1 * 9/2002 Deguchi et al. ..... 343/700 MS
2002/0126048 A1 * 9/2002 Zhu et al. ..... 343/700 MS
2003/0068980 A1 * 4/2003 Nakagawa et al. ..... 455/13.3

FOREIGN PATENT DOCUMENTS

| | | |
|---|---|---|
| GB | 2281661 | 3/1995 |
| GB | 2387486 | 10/2003 |
| WO | WO03/103361 | 12/2003 |

* cited by examiner

*Primary Examiner*—Don Wong
*Assistant Examiner*—Huedung X. Cao
(74) *Attorney, Agent, or Firm*—Lowe Hauptman & Berner, LLP

(57) ABSTRACT

This invention concerns a device comprises a fixing part having a horizontal fixing part for placing the radiation part thereon and a vertical fixing part connected perpendicularly to horizontal fixing part, and a supporting part spaced apart from the fixing part. The device further comprises a supporting part spaced apart from an outer lower end of the vertical fixing part by a predetermined distance for supporting the terminal part to prevent separation of the terminal part from contact parts of the mobile communication terminal or deformation of the radiation part against a pressure applied to the terminal part when the built-in antenna is mounted in the main body of the mobile communication terminal.

9 Claims, 11 Drawing Sheets

BUILT-IN ANTENNA TERMINAL PART SUPPORTING DEVICE

BACKGROUND OF THE INVENTION

1. Field of the Invention

The present invention relates to a built-in antenna for mobile communication terminals, and more particularly to a device for supporting a terminal part used for circuit connection between a built-in antenna and a main body of a mobile communication terminal when the built-in antenna is mounted in the mobile communication terminal.

2. Description of the Related Art

Various technologies have been applied to mobile communication terminals in order to improve portability and usability of the mobile communication terminals. Also, the mobile communication terminals have been designed in various ways. As a result, built-in circuits and parts adopted in the mobile communication terminals have been miniaturized and lightened. However, the existing mobile communication terminals generally have external antennas fixed to the upper ends thereof, such as helical antennas or monopole antennas. These external antennas are outwardly protruded from the mobile communication terminals, whereby portability of the mobile communication terminals is poor, and design of the mobile communication terminals is not appealing. Consequently, there has been developed a built-in antenna which is mounted in the mobile communication terminal and therefore is not outwardly protruded from the mobile communication terminal.

FIG. 1 is a perspective view of a conventional built-in antenna.

As shown in FIG. 1, the built-in antenna comprises an radiation part 10 and a terminal part 20. The radiation part 10 is placed on the top surface of a fixing part 50, which is made of a dielectric substance, and the terminal part 20 is arranged on the side surface of the fixing part 50. The radiation part 10 corresponds to transmitting and receiving parts of the antenna. The radiation part 10 is fixed by means of the fixing part 50. The terminal part 20 comprises a current feeding pin 21 and a grounding pin 22.

FIG. 2*a* is a side view of a conventional right-angled built-in antenna.

As shown in FIG. 2*a*, the terminal part 20 of the right-angled built-in antenna is connected to the radiation part 10 of the right-angled built-in antenna while the terminal part 20 is perpendicular to the radiation part 10. Contact points 23 are formed at one end of the terminal part 20 of the right-angled built-in antenna. Specifically, the contact points 23 are formed at the ends of the current feeding pin 21 and the grounding pin 22, respectively. The contact points 23 make contact with a main body of the mobile communication terminal for feeding current to the current feeding pin 21 and grounding the grounding pin 22.

FIG. 2*b* is a side view showing an effect of pressure when the conventional right-angled built-in antenna is mounted to the main body of the mobile communication terminal.

As shown in FIG. 2*b*, the contact points 23 make contact with the main body (not shown) of the mobile communication terminal when the right-angled built-in antenna is mounted to the main body of the mobile communication terminal. At this time, a vertical upward pressure is applied to the terminal part 20 of the right-angled built-in antenna, which affects the radiation part 10 of the right-angled built-in antenna. The radiation part 10 is arranged while being spaced a predetermined distance from the fixing part 50. When the radiation part 10 is vertically and upwardly pressurized, a portion L of the radiation part 10 becomes spaced more than the predetermined distance from the fixing part 50. Such deformation of the radiation part 10 changes the radiation pattern of the antenna with the result that the degree of freedom in design of the radiation part 10 of the right-angled built-in antenna is reduced, and performance of the radiation part 10, i.e., performance of the antenna is deteriorated.

FIG. 3*a* is a side view of a conventional hook-shaped built-in antenna.

As shown in FIG. 3*a*, the terminal part 20 of the hook-shaped built-in antenna is connected to the radiation part 10 of the hook-shaped built-in antenna while the terminal part 20 is perpendicular to the radiation part 10. At one end of the terminal part 20 of the hook-shaped built-in antenna are formed contact points 23. Unlike the aforesaid right-angled built-in antenna, however, a portion of the terminal part 20 is bent to a predetermined angle toward the inside of the fixing part 50, which forms a pressure absorption piece 30. The pressure absorption piece 30 absorbs the vertical pressure applied upward to the terminal part 20 when the hook-shaped built-in antenna is mounted in the mobile communication terminal. Consequently, the radiation part 10 of the hook-shaped built-in antenna is not deformed unlike the aforesaid right-angled built-in antenna.

FIG. 3*b* is a side view showing an effect of pressure when the hook-shaped built-in antenna is mounted to the main body of the mobile communication terminal.

As shown in FIG. 3*b*, the pressure absorption piece 30 absorbs the vertical pressure applied upward to the terminal part 20 when the hook-shaped built-in antenna is mounted in the mobile communication terminal. It should be noted, however, that there may be applied a horizontal pressure in addition to the vertical upward pressure when the hook-shaped built-in antenna is mounted in the mobile communication terminal. When the horizontal pressure is applied to the terminal part 20 including the pressure absorption piece 30 toward the inside of the fixing part 50 (in the direction indicated by an arrow A), the terminal part 20 is supported by means of the fixing part 50. When the horizontal pressure is applied to the terminal part 20 including the pressure absorption piece 30 toward the outside of the fixing part 50 (in the direction indicated by an arrow B), on the other hand, the terminal part 20 is deformed since it is not supported. When the terminal part of the hook-shaped built-in antenna is deformed as described above, the contact points 23 are separated from the corresponding contact parts of the main body of the mobile communication terminal, whereby no prescribed circuit is formed. Furthermore, the terminal part 20 may be easily deformed when the mobile communication terminal is assembled or an outer case of the mobile communication terminal is assembled.

SUMMARY OF THE INVENTION

Therefore, the present invention has been made in view of the above problems, and it is an object of the present invention to provide a device for preventing deformation of an radiation part and a terminal part of a built-in antenna and thus preventing separation of the terminal part from a main body of a mobile communication terminal when the built-in antenna is mounted in the main body of the mobile communication terminal.

In accordance with the present invention, the above and other objects can be accomplished by the provision of a device for supporting a terminal part of a built-in antenna for mobile communication terminals, the built-in antenna comprising an radiation part for transmitting and receiving a radio wave, and the terminal part connected to one end of the radiation part for feeding current and grounding, the device comprising: a fixing part comprising a horizontal fixing part for placing the radiation part thereon, and a vertical fixing part connected perpendicularly to the horizontal fixing part, the terminal part being arranged on the vertical fixing part; and a supporting part spaced apart from an outer lower end of the vertical fixing part by a predetermined distance (D) for supporting the terminal part to prevent separation of the terminal part from contact parts of the mobile communication terminal or deformation of the radiation part against a pressure applied to the terminal part when the built-in antenna is mounted in the main body of the mobile communication terminal.

Preferably, the supporting part is spaced apart from the outside of the vertical fixing part by a predetermined distance (D').

Preferably, the supporting part has a top surface spaced apart from a bottom surface of the vertical fixing part by a predetermined distance (D).

Preferably, the supporting part has a bottom surface placed on the same horizontal line as a bottom surface of the vertical fixing part.

Preferably, the supporting part has a top surface placed on the same horizontal line as a bottom surface of the vertical fixing part.

Preferably, the supporting part is disposed below the vertical fixing part and the supporting part has a top surface spaced apart from a bottom surface of the vertical fixing part by a predetermined distance (D).

Preferably, the supporting part has a surface adjacent to the fixing part, the surface of the supporting part adjacent to the fixing part being placed on the same vertical line as an outside surface of the vertical fixing part.

Preferably, the device further comprises a guiding part extended approximately vertically from the outer edge of a top surface of the supporting part and having a thickness smaller than that of the supporting part.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
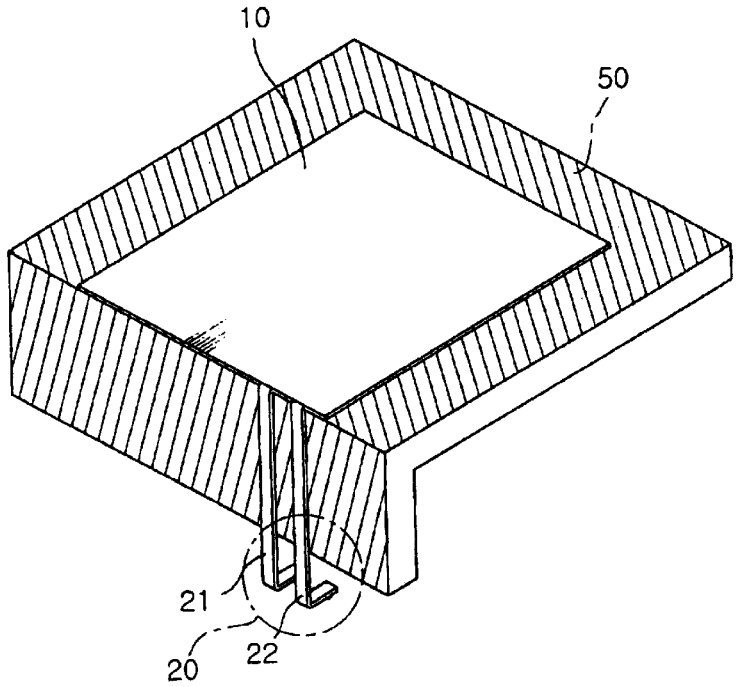
PRIOR ART FIG. 1
FIG. 1 is a perspective view of a conventional built-in antenna.
Figure 2A:
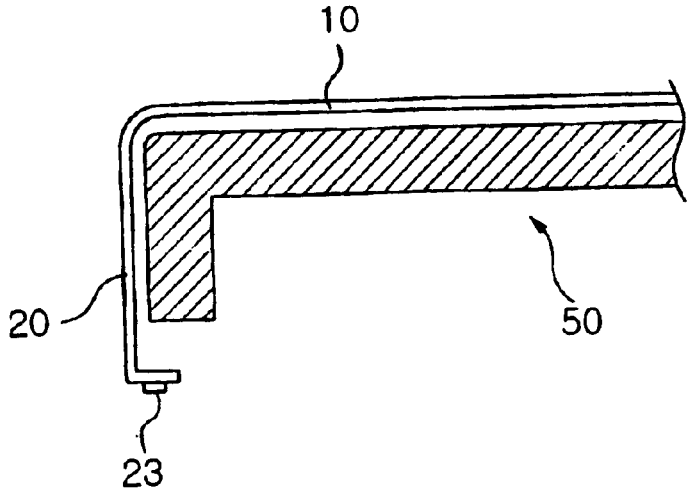
PRIOR ART FIG. 2a
FIG. 2*a* is a side view of a conventional right-angled built-in antenna.
Figure 2B:
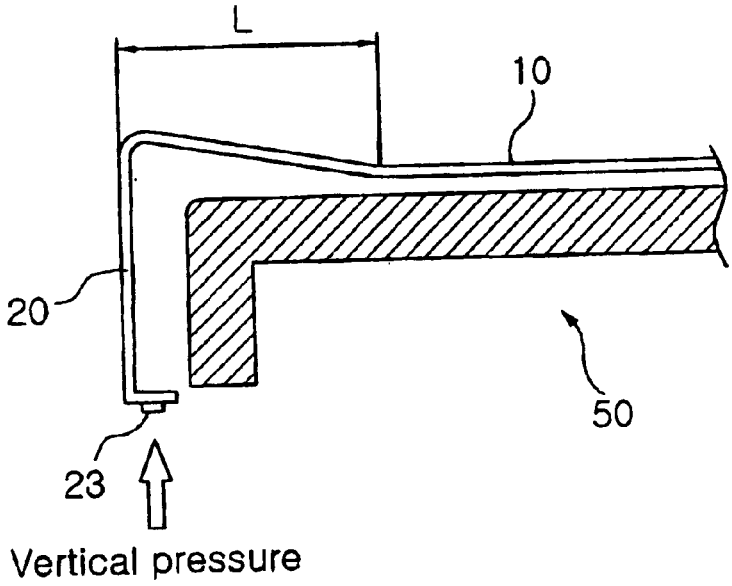
PRIOR ART FIG. 2b
FIG. 2*b* is a side view showing an effect of pressure when the conventional right-angled built-in antenna is mounted to a main body of a mobile communication terminal.
Figure 3A:
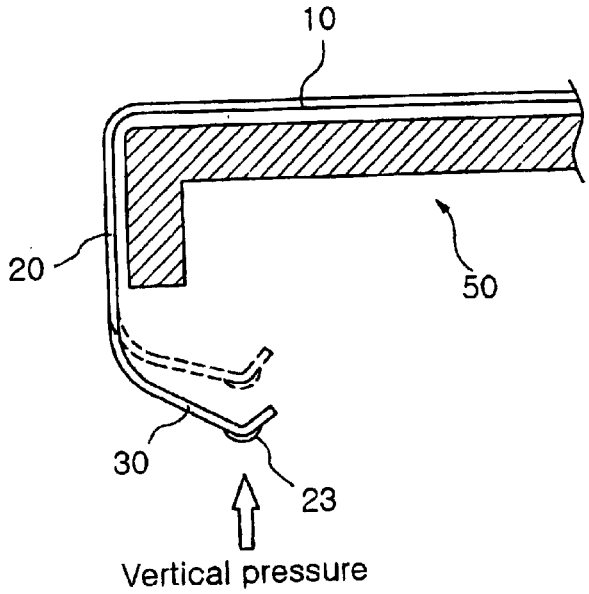
PRIOR ART FIG. 3a
FIG. 3*a* is a side view of a conventional hook-shaped built-in antenna.
Figure 3B:
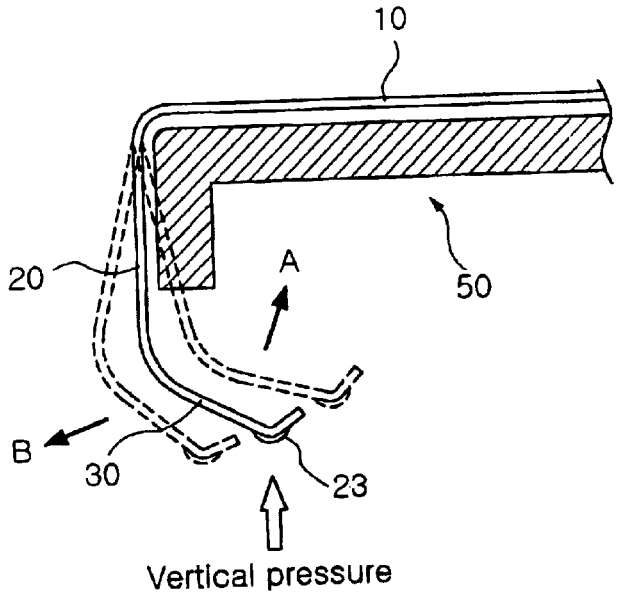
PRIOR ART FIG. 3b
FIG. 3*b* is a side view showing an effect of pressure when the conventional hook-shaped built-in antenna is mounted to a main body of a mobile communication terminal.

Now, preferred embodiments of the present invention will be described in detail with reference to the accompanying drawings. In the drawings, the same or similar elements are denoted by the same reference numerals even though they are depicted in different drawings. In the following, a detailed description of known functions and configurations incorporated herein will be omitted when it may make the subject matter of the present invention rather unclear.

Figure 4A:
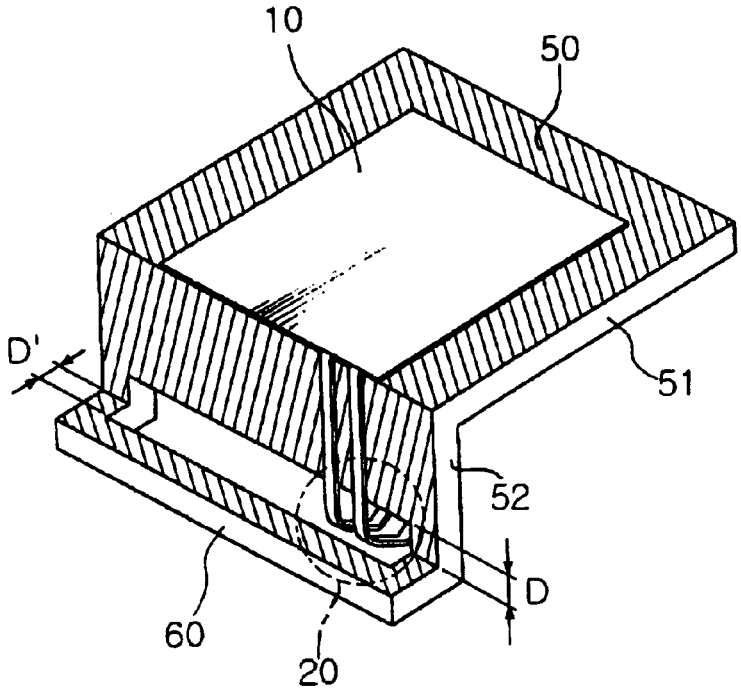
FIG. 4*a* is a perspective view of a built-in antenna assembled with a supporting device according to a preferred embodiment of the present invention.

FIG. 4*a* is a perspective view of a built-in antenna assembled with a supporting device according to a preferred embodiment of the present invention.

As shown in FIG. 4*a*, according to the present invention a supporting device for the built-in antenna comprises a fixing part 50 and a supporting part 60. The fixing part 50 comprises a horizontal fixing part 51 on which a radiation part 10 of the built-in antenna is placed, and a vertical fixing part 52 connected perpendicularly to the horizontal fixing part 51. On the vertical fixing part 52 is arranged a terminal part 20. Consequently, the built-in antenna is placed on the fixing part 50 while being spaced a predetermined distance from the fixing part 50 so that the built-in antenna is fixed by means of the fixing part 50. The supporting part 60 is formed at the outer lower end of the vertical fixing part 52. The bottom surface of the vertical fixing part 52 and the supporting part 60 are spaced apart from each other by a predetermined distance D. Similarly, the outside surface of the vertical fixing part 52 and the supporting part 60 are spaced apart from each other by a predetermined distance D'.

Various built-in antennas with different forms may be realized by forming the radiation part 10 of the antenna and the fixing part 50 in various ways.

Figure 4B:
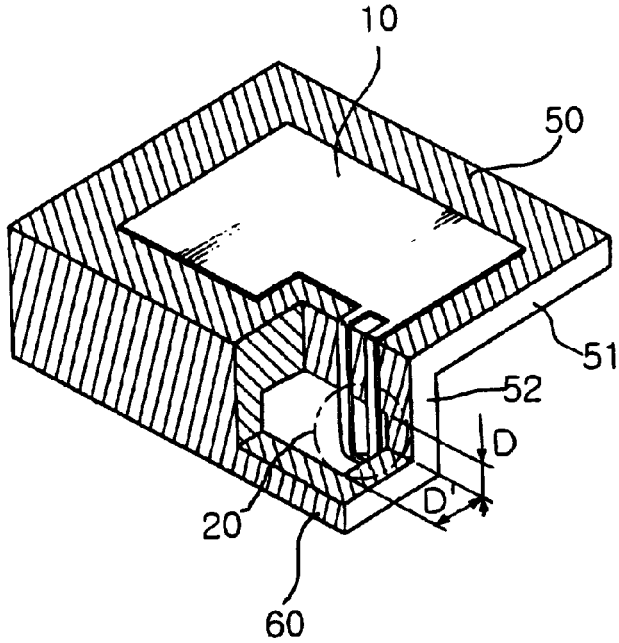
FIG. 4*b* is a perspective view of a built-in antenna assembled with a supporting device according to another preferred embodiment of the present invention.

FIG. 4*b* is a perspective view of a supporting device according to another preferred embodiment of the present invention.

As shown in FIG. 4*b*, the terminal part 20 of the antenna is disposed in a groove formed in the fixing part 50. In this case, the supporting device is formed in the shape surrounding the groove of the fixing part 50.

Figure 5A:
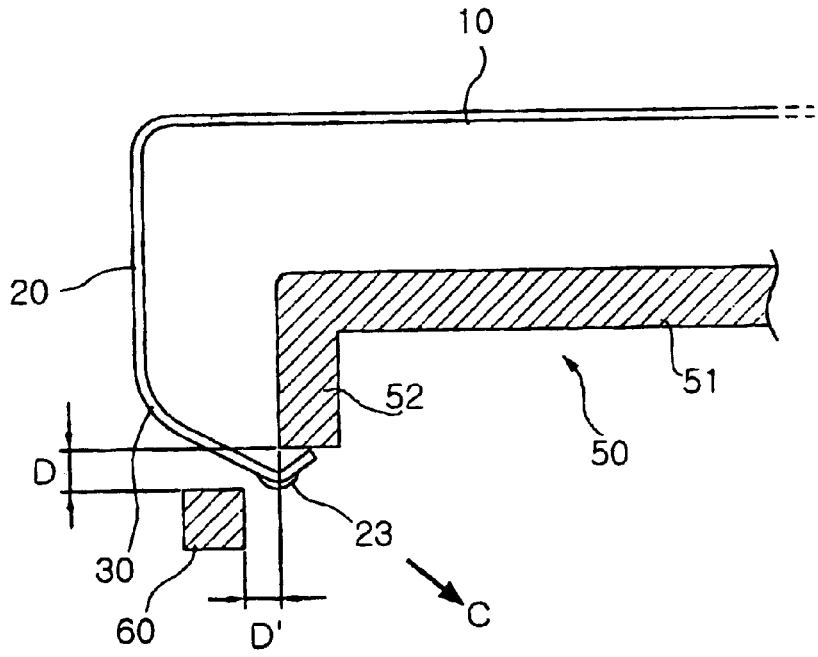
FIG. 5*a* is a sectional view of a built-in antenna assembled with a supporting device according to still another preferred embodiment of the present invention.

FIG. 5*a* is a sectional view of a built-in antenna assembled with a supporting device according to still another preferred embodiment of the present invention.

In the present invention, the pressure absorption piece 30 can be easily inserted between the fixing part 50 and the supporting part 60 in the direction perpendicular to the diagonal direction between one end of the fixing part 50 and the supporting part 60 (in the direction indicated by an arrow C) even when the hook-shaped built-in antenna is mounted in the main body of the mobile communication terminal as shown in FIG. 5*a*. Consequently, the assembly operation for manufacturing built-in antennas is easily performed. Also, the supporting part 60 is miniaturized so that the supporting part 60 is disposed outside or under the fixing part 50 as shown in FIG. 5*a* with the result that the built-in antenna terminal part with the supporting device of the present invention has a minimal structure. When the built-in antenna with such a minimal terminal part supporting device is adopted, it is possible to realize miniaturization and aesthetic design of the mobile communication terminal.

Figure 5B:
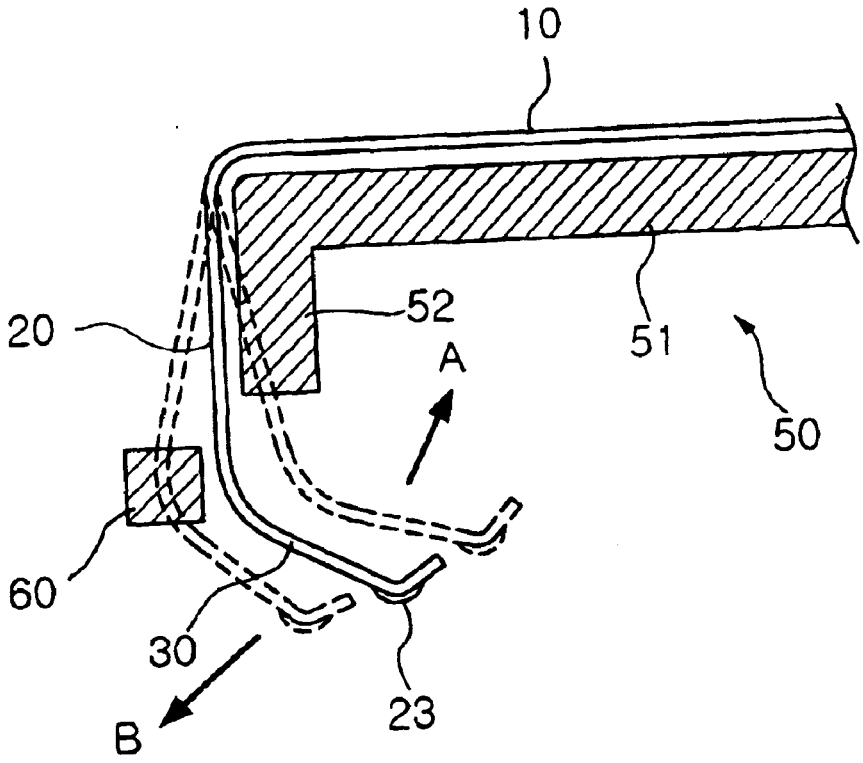
FIG. 5*b* is a sectional view showing an effect of pressure when a built-in antenna, to which the supporting device of the present invention is applied, is mounted to a main body of a mobile communication terminal.

FIG. 5*b* is a sectional view showing an effect of pressure when the built-in antenna, to which the built-in antenna terminal part supporting device of the present invention is applied, is mounted to the main body of the mobile communication terminal.

When the hook-shaped built-in antenna is mounted in the main body of the mobile communication terminal using the supporting device for the built-in antenna of the present invention as shown in FIG. 5*b*, the terminal part 20 can be supported against the horizontal pressure applied to the terminal part 20. Specifically, when the horizontal pressure is applied to the terminal part 20 including the pressure absorption piece 30 toward the inside of the fixing part 50 (in the direction indicated by an arrow A), the terminal part 20 is supported by means of the fixing part 50. On the other hand, when the horizontal pressure is applied to the terminal part 20 including the pressure absorption piece 30 toward the outside of the fixing part 50 (in the direction indicated by an arrow B), the terminal part 20 is supported by means of the supporting part 60. Consequently, the influence of the horizontal pressure is effectively reduced, and thus deformation of the terminal part 20 of the built-in antenna is prevented.

FIGS. 5*c* to 5*f* are sectional views of supporting devices according to other preferred embodiments of the present invention, respectively.

Figure 5C:
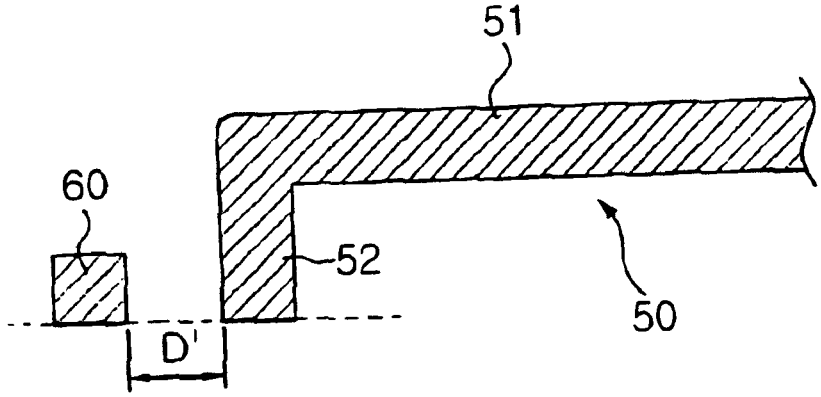
FIGS. 5*c* to 5*f* are sectional views of supporting devices according to other preferred embodiments of the present invention, respectively.
Figure 5D:
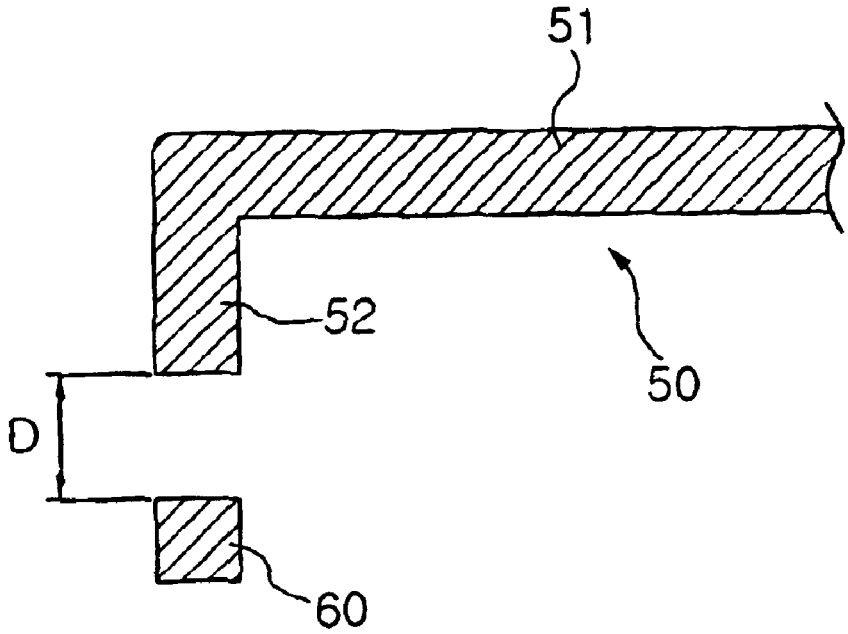
Figure 5E:
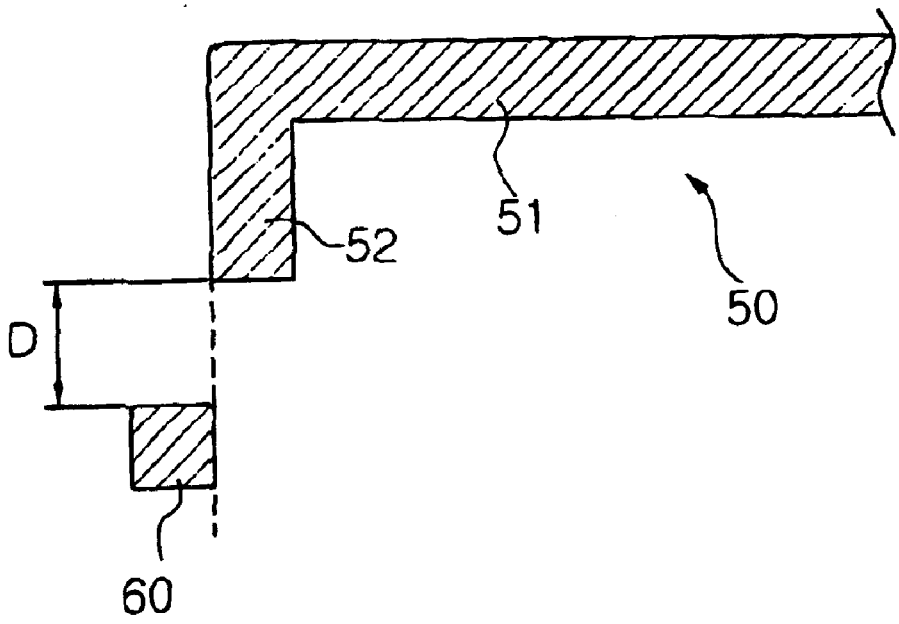
Figure 5F:
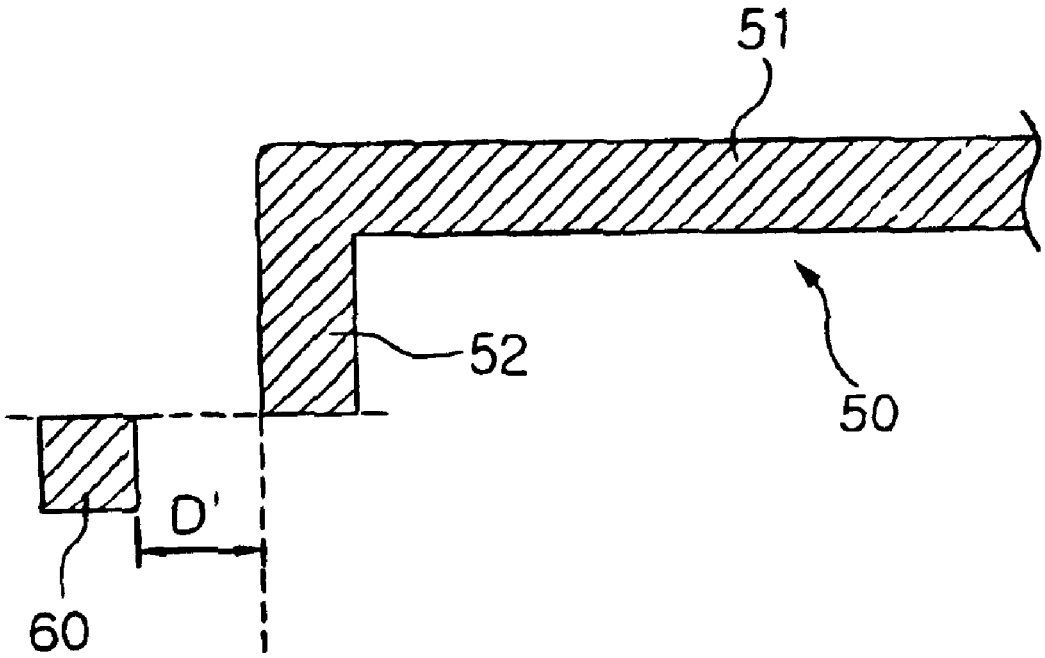

According to the preferred embodiment of the present invention as shown in FIG. 5*c*, the supporting part 60 is spaced apart from the outside of the vertical fixing part 52 by a predetermined distance D', and the bottom surface of the supporting part 60 and the bottom surface of the vertical fixing part 52 are placed on the same horizontal line. According to the preferred embodiment of the present invention as shown in FIG. 5*d*, the supporting part 60 is disposed below the vertical fixing part 52 while the supporting part 60 is spaced apart from the bottom surface of the vertical fixing part 52 by a predetermined distance D. According to the preferred embodiment of the present invention as shown in FIG. 5*e*, on the other hand, the top surface of the supporting part 60 is spaced apart from the bottom surface of the vertical fixing part 52 by a predetermined distance D, and the surface of the supporting part 60, which is adjacent to the fixing part 50, and the outside surface of the vertical fixing part 52 are placed on the same vertical line. According to the preferred embodiment of the present invention as shown in FIG. 5*f*, the supporting part 60 is spaced apart from the outside of the vertical fixing part 52 by a prescribed distance D', and the top surface of the supporting part 60 and the bottom surface of the vertical fixing part 52 are placed on the same horizontal line.

Figure 6:
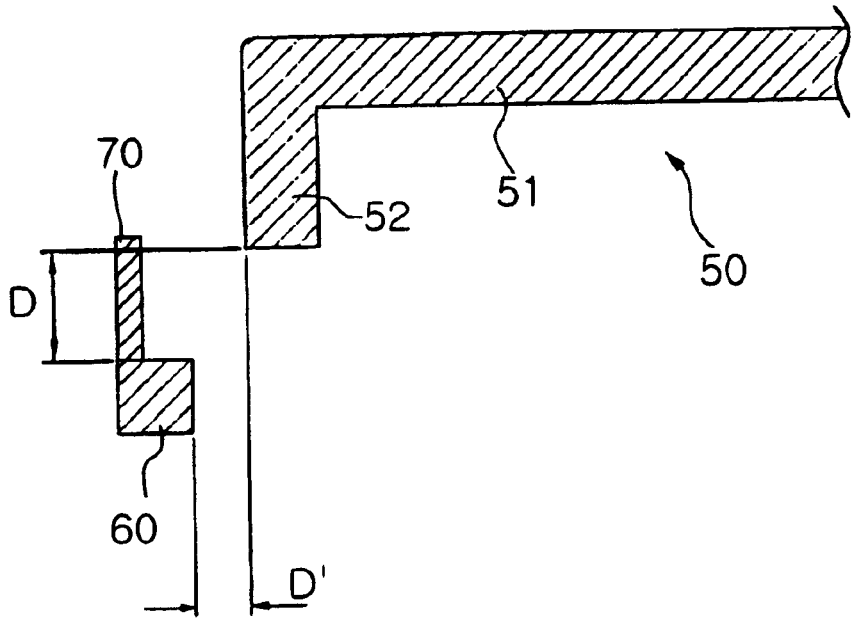
FIG. 6 is a sectional view of a supporting device according to still another preferred embodiment of the present invention.

FIG. 6 is a sectional view of the supporting device for the built-in antenna according to still another preferred embodiment of the present invention. As shown in FIG. 6, the supporting device of the present invention further comprises a guiding part 70 in addition to the fixing part 50 and the supporting part 60. The guiding part 70 is approximately vertically extended from the top surface of the supporting part 60. The guiding part 70 has a thickness smaller than that of the supporting part 60. Preferably, the guiding part 70 is formed at the outer edge of the top surface of the supporting part 60, as shown in FIG. 6. The guiding part 70 serves to guide the terminal part of the antenna so that the terminal part of the antenna is easily inserted between the fixing part 50 and the supporting part 60, and to protect the terminal part from external impacts so that the circuits can be formed more stably.

As apparent from the above description, the present invention provides the supporting device which is capable of preventing deformation of an radiation part and a terminal part of the built-in antenna, thereby improving transmitting and receiving efficiency of the antenna for the mobile communication terminals.

According to the present invention, separation of the terminal part from a main body of a mobile communication terminal is prevented, whereby formation of a circuit is easy.

The present invention provides an efficient structure in assembling the mobile communication terminal or an outer case of the mobile communication terminal, thereby improving production efficiency.

Furthermore, the built-in antenna terminal part supporting device of the present invention is formed in a minimal structure, whereby miniaturization and aesthetic design of the mobile communication terminal is realized.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for supporting a terminal part of a built-in antenna for mobile communication terminals, the built-in antenna comprising an radiation part for transmitting and receiving a radio wave, and the terminal part connected to one end of the radiation part for feeding current and grounding, the device comprising:

a fixing part comprising a horizontal fixing part for placing the radiation part thereon, and a vertical fixing part connected perpendicularly to the horizontal fixing part, the terminal part being arranged on the vertical fixing part; and a supporting part spaced apart from an outer lower end of the vertical fixing part by a predetermined distance for supporting the terminal part to prevent separation of the terminal part from contact parts of the mobile communication terminal or deformation of the radiation part against a pressure applied to the terminal part when the built-in antenna is mounted in the main body of the mobile communication terminal.

2. The device as set forth in claim 1, wherein the supporting part is spaced apart from the outside of the vertical fixing part by a predetermined distance.

3. The device as set forth in claim 2, wherein the supporting part has a top surface spaced apart from a bottom surface of the vertical fixing part by a predetermined distance.

4. The device as set forth in claim 2, wherein the supporting part has a bottom surface placed on the same horizontal line as a bottom surface of the vertical fixing part.

5. The device as set forth in claim 2, wherein the supporting part has a top surface placed on the same horizontal line as a bottom surface of the vertical fixing part.

6. The device as set forth in claim 1, wherein the supporting part is disposed below the vertical fixing part and the supporting part has a top surface spaced apart from a bottom surface of the vertical fixing part by a predetermined distance.

7. The device as set forth in claim 6, wherein the supporting part has a surface adjacent to the fixing part, the surface of the supporting part adjacent to the fixing part being placed on the same vertical line as an outside surface of the vertical fixing part.

8. The device as set forth in claim 1, wherein the terminal part is a hook-shaped terminal part having one end bent to a predetermined angle toward the inside of the fixing part.

9. The device as set forth in claim 1, further comprising a guiding part extended approximately vertically from the outer edge of a top surface of the supporting part and having a thickness smaller than that of the supporting part.

* * * * *